United States Patent [19]

Feld

[11] 4,036,090

[45] July 19, 1977

[54] FABRIC SPREADING CARRIAGE FOR FACE UP, ONE WAY OPERATION HAVING FABRIC CLAMPING CUTTING ASSEMBLY

[76] Inventor: Jerome H. Feld, 1500 Ocean Parkway, Brooklyn, N.Y. 11230

[21] Appl. No.: 557,401

[22] Filed: Mar. 11, 1975

Related U.S. Application Data

[62] Division of Ser. No. 436,150, Jan. 24, 1974, Pat. No. 3,941,366.

[51] Int. Cl.[2] ..... B26D 5/20

[52] U.S. Cl. ..... 83/282; 83/455; 83/460; 83/465; 83/614; 270/31

[58] Field of Search ..... 270/30, 31, 69; 83/282, 83/380, 390, 455, 458, 460, 465, 614, 488, 174, 461

[56] References Cited

U.S. PATENT DOCUMENTS

| | | | |
|---|---|---|---|
| 3,094,319 | 6/1963 | Deichmann | 270/31 |
| 3,641,854 | 2/1972 | Keesling | 83/455 X |
| 3,672,662 | 6/1972 | Grimm et al. | 270/31 |
| 3,889,562 | 6/1975 | Schiesser | 83/455 X |
| 3,919,905 | 11/1975 | Hoffman | 83/455 X |

*Primary Examiner*—Othell M. Simpson
*Assistant Examiner*—W. D. Bray

[57] ABSTRACT

A carriage assembly for automatic face up one way spreading of multiple plys of fabric or any other web-like material of a predetermined length, which is automated to operate in a continuous manner in the absence of operator manipulation at the termination of each fabric spreading cycle. The device incorporates a fabric or web-cutting assembly normally enclosing a transversely traveling severing blade and means for automatically engaging the free end of the fabric after sequenced severing so as to maintain the fabric in a fixed relation relative to the assembly during return or non-spreading carriage motion thereby preventing disturbance or change of position of the free end of the fabric as caused by carriage motion airflow, so that upon automatic recommencement of spreading, the end of the fabric will be deposited at a predetermined position on the spreading surface which will be accurately repeated for each subsequent automatically deposited ply of fabric, thereby providing maximum fabric utilization.

3 Claims, 9 Drawing Figures

FABRIC SPREADING CARRIAGE FOR FACE UP, ONE WAY OPERATION HAVING FABRIC CLAMPING CUTTING ASSEMBLY

This application is a division of application Ser. No. 436,150, filed Jan. 24, 1974, now U.S. Pat. No. 3,941,366.

BACKGROUND OF THE INVENTION

This invention relates generally to the field of fabric spreading machines, and more particularly to a fabric spreading carriage or an attachment for an existing carriage adapted for so-called "face up, one way" operation in a completely automatic manner.

As known in the art, face up operation of the fabric spreading carriage is required when the fabric being spread is not identical on both surfaces thereof, necessitating a disposition of the fabric with like surfaces facing in the same direction. Such is the case when the derived multiple ply marker cut fabric sections are loaded into automated stitching system without the need for turning over alternate plies. One way spreading is required when, in addition, the face of the fabric being spread consists of a longitudinal unilaterally-oriented design or texture, where by virtue of marker composition it is necessary that the fabric design or texture be oriented in the same direction in all plies of the fabric being spread. To meet the face up requirement, it is not possible to deposit the fabric on the spreading table as a continuous web, the layers of which are interconnected by 180° folds. Instead, with the deposition of each play of fabric, the web is severed at the end of the fabric spreading movement of the carriage over the table, and the following ply is independently positioned to overlie the ply previously spread. Where a substantial amount of one way work is required, it is common to provide in the carriage a turntable means for supporting the fabric supply, which is rotated through 180° at the end of each movement over the table, so that fabric may be laid in both directions with the same side facing upwardly. Spreading in this fashion to relatively expeditious since fabric is being spread in both directions of spreading machine travel. However, it does not provide for one way spreading. Where a turntable was not present it is common to provide an attachment for the carriage through which the fabric web passes. The attachment includes an elongated box having a cutting blade mounted for reciprocation transversely of the path of movement of the carriage. At the completion of the deposition of a singly ply of fabric the cutting means is operative to sever that ply of fabric, following which the carriage returns to the opposite end of the table, and the free edge of the severed web is manually threaded through the cutter box forming a part of the attachment, and a second ply is subsequently deposited upon the first one. Care must be exercised to align the edge of the web with the edge of the previously laid ply, in order not to waste fabric. Where the carriage includes a positively driven driven feed roller, it is customary to disengage the clutch connecting the feed roller with driving means powered by the movement of the carriage over the table, so that the cloth web may be manually adjusted prior to commencement of cloth feed. This operation normally requires the opening of the cutter box, the threading of the web therethrough, the manual closing of the box, the pulling of fabric down to the table to the requisite degree, and the re-engagement of the clutch interconnecting the positive drive feed roll with its driving means. At the opposite end of the table, a limit switch on the carriage strikes a cam adjustably mounted on the table to stop the carriage, which action may automatically activate the web cutting blade in the cutter box, but operations at the first mentioned end of the table have been performed manually with a considerable expenditure of time on the part of skilled personnel.

It has been known in the art to completely automate fabric spreading carriages for continuous web deposition, so that while the device is in operation, little if any supervision on the part of the operator is necessary.

DESCRIPTION OF THE PRESENT INVENTION

Briefly stated, the invention contemplates the provision of face up one way operation of automated carriages, in which the clamping of the end of the fabric web after severing of the previously spread segment is automatically performed on the carriage itself, and in which the positive drive roller which provides tensionless feeding of the web is simultaneously locked against movement. After the completion of a spreading cycle, the carriage returns to the other end of the fabric spreading table to commence a subsequent spreading operation. Means is provided to prevent loss of phase between the positive drive feed roller and the means driving the same upon recommencement of feeding, whereby the free end edge of the web is deposited with great accuracy upon the corresponding edge of the previously laid segment of fabric. The cutter box is provided with movable sides enabling the upper portion of one wall thereof to serve as a selective fabric web clamping means, and a lower portion containing the cutting trough can selectively move laterally with respect to the plane of the fabric web disposed therein to clear any potential sticking of the free end of the fabric web in the trough which would prevent or interfere with subsequent feeding. In the preferred embodiment, the clamping action is mechanical in nature and accomplished by the moving of one wall of the cutter box relative to an opposed wall. In another embodiment, the clamping and clearing functions are accomplished pneumatically.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENTS

Figure 1:
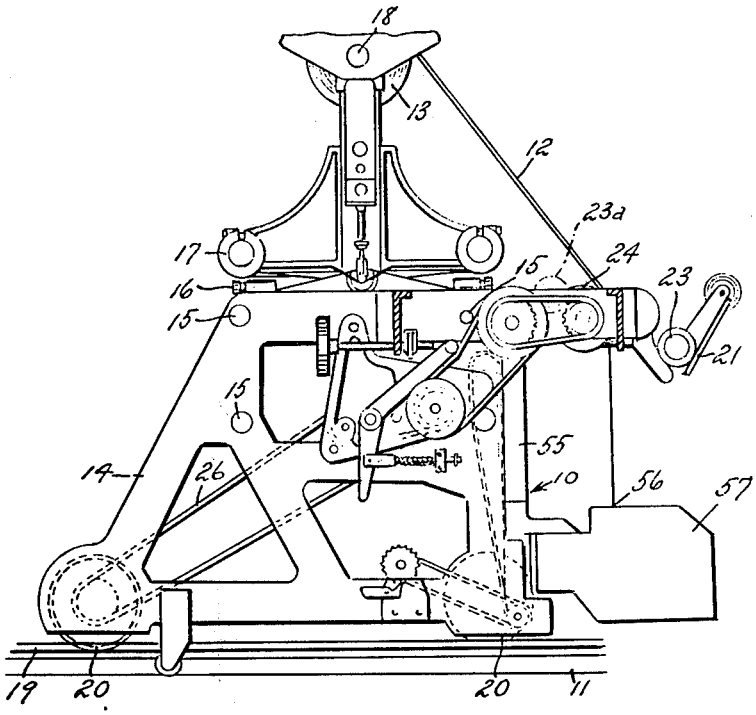
FIG. 1 is a side elevational view of a cloth laying carriage embodying the invention.

Referring to FIG. 1 in the drawings, there is shown a spreading machine 10 mounted to move along a table 11 to spread a web 12 of fabric or other material from a supply roll 13 of such material. The device 10 includes a pair of laterally spaced end frames, one of which is indicated by reference character 14, which are rigidly interconnected in spaced relation by tubular cross members 15 to define a carriage. Riding upon an upper pair of members 15 is a carrier 16 supporting in turn a turntable 17 which mounts a fabric supply spindle 18 carrying the roll 13. The above structure is described in greater detail in U.S. Pat. No. 3,233,488 granted Feb. 8, 1966, and assigned to the same assignee as the instant application. Reference is made to said patent for a detailed description of this structure.

In order to properly guide the carriage 10 for movement longitudinally over the table, one or more tracks 19 are secured to at least one longitudinal edge thereof. The wheels 20 of one of the frames 14 is guided by the track 19 in well known manner.

Figure 7:
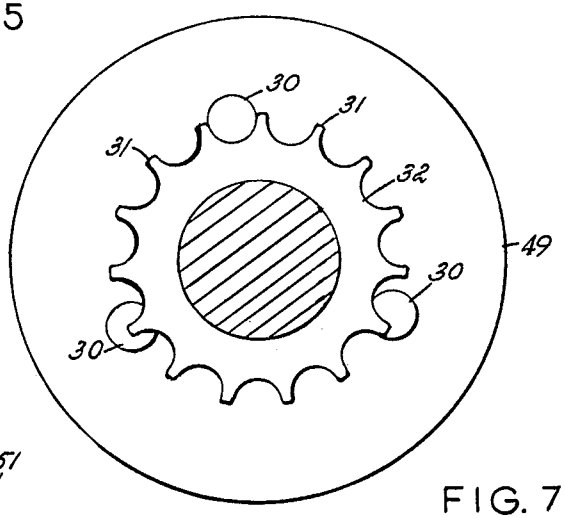
FIG. 7 is an enlarged sectional view as seen from the plane 7—7 in FIG. 6.
Figure 6:
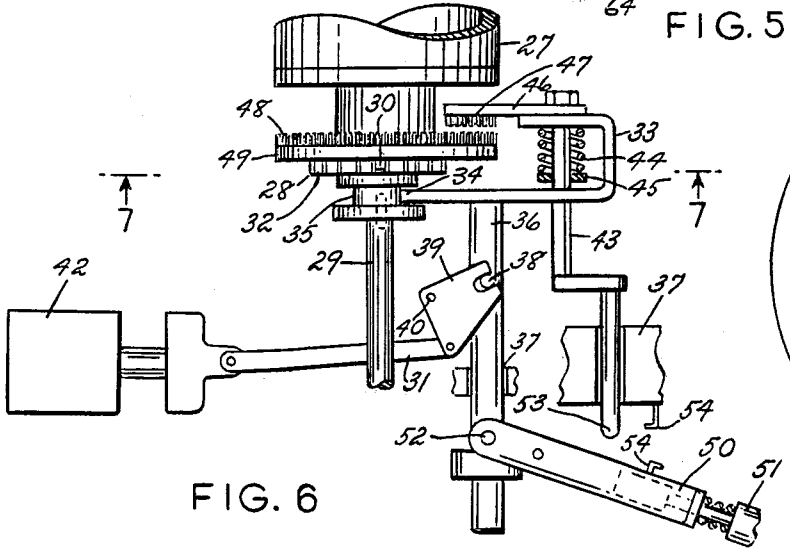
FIG. 6 is a fragmentary top plan view showing the details of means for driving a positive drive fabric feed roller, and locking same against movement during the return stroke of the carriage.

To insure contact between the fabric and the positive drive feed roller 24, there is provided a swingable frame 21 comprising an opposed pair of end frames, which are interconnected by a tie rod 23 and roller 23*a*. Roller 23*a* causes the fabric to contact approximately half of the positive feed roller surface. The positive drive feed roller 24 receives motion from a left hand wheel 20 through a sprocket chain 26, the interconnection being a well known type which results in rotation of the positive drive feed roller 24 in a clockwise direction as seen in FIG. 1, irrespective of the direction of movement of the carriage, and causes the feed roller peripheral speed to be equal to the speed of the carriage over the spreading surface thereby spreading the fabric in a tensionless fashion. Referring to FIG. 6, a clutch means 28 permits disengagement of the roll member 27 from transmitted movement of the sprocket chain 26. This means includes a driven shaft 29 coaxially aligned with the roll 24. A plurality of resiliently mounted drive pins 30 project axially of the roll 24 and are adapted to be engaged between the teeth 31 of a sprocket 32 on the shaft 29. As seen in FIG. 7, the pins 30 are three in number, and are positioned in even increments unrelated to the pitch of the teeth on the sprocket, so that upon reengagement, one of the pins will be more nearly aligned for engagement than the others, and only limited rotation of the sprocket will occur before a pin 30 snaps into position in an interstice between the teeth. In the case of a sprocket having 16 teeth, the maximum amount of lost motion is 3.75° of rotation, with a 4 inch diameter feed roller, will effectively start the spread of each ply of fabric within approximately one eighth inch of a reference line on the spreading surface, thus insuring maximum utilization of fabric.

Referring again to FIG. 6, a C-shaped yoke 33 includes a projection 34 riding in a groove 35 of the hub of the sprocket 32. The yoke mounts a laterally extending control shaft 36 supported in a bearing 37, the shaft having laterally projecting pins 38 engageable with a bell crank member 39 mounted for pivotal movement about a vertical axis 40. A connecting link 31 is interconnected to the armature of an operating soleniod 42, and it will be apparent that energizing and de-energizing of the soleniod will result in shifting of the yoke upwardly and downwardly as seen in FIG. 6 to engage or disengage the sprocket 32 with one of the pins 30.

A slideably mounted linkage 43 is urged to the position shown in FIG. 6 by a coil spring 44 bearing against a collar 45 secured to linkage 43. The linkage 43 includes a laterally extending member 46 having a brake facing 47 selectively engageable with a corresponding facing 48 on a plate 49 in fixed relation to the roll 24. The brake facings consisting of densely distributed stiff fibers, permits partial braking prior to complete disengagement of the drive pins thus preventing fabric spreading start position error due to feed roller rotation caused by fabric tension. A manual release 50 permits disengagement of the brake facings 47 and 48 when free rotation of the feed roller 24 is desired, as, for example, when initially threading a fresh roll of fabric prior tp commencement of spreading. The release 50 includes a pivotally mounted handle 51 rotating about a point 52 (see FIG. 6) in a counter clockwise direction, wherein it strikes an offset link 53 to move the same upwardly, compressing the spring 44. Suitable latching means 54 may be included if desired.

Referring again to FIG. 1, a pair of U-shaped channel members, one of which is indicated by reference character 55 supports a fabric web cutting element 56 including a cutter box 57 supporting for transverse reciprocation a cutter assembly 58 the details, again, of which are disclosed in the above mentioned U.S. Pat. No. 3,233,448, and which form no part of the present disclosure. Mounting brackets 59 (FIG. 2) enable the cutter box to be detachably supported by the carriage 10.

Figure 5:
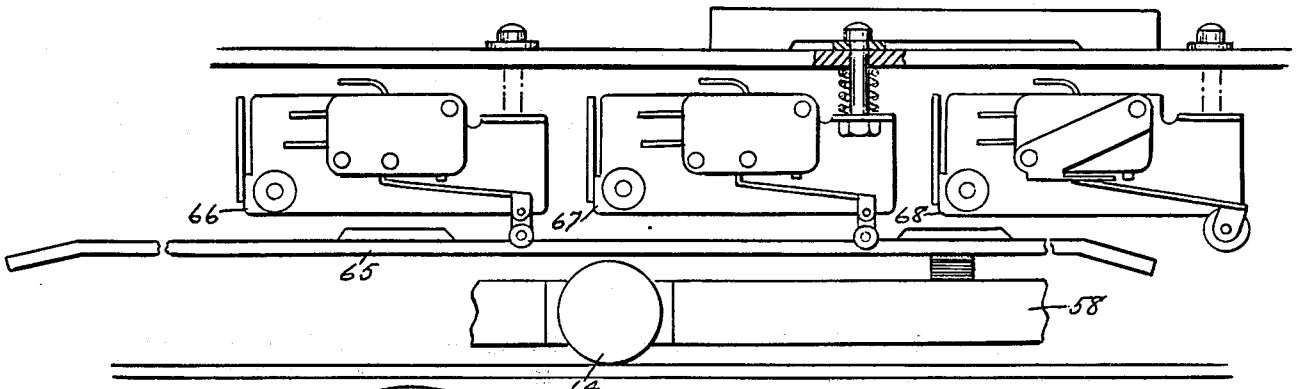
FIGS. 5 is a fragmentary vertical sectional view showing the details of the actuation of cutter box snap actuating switches.
Figure 8:
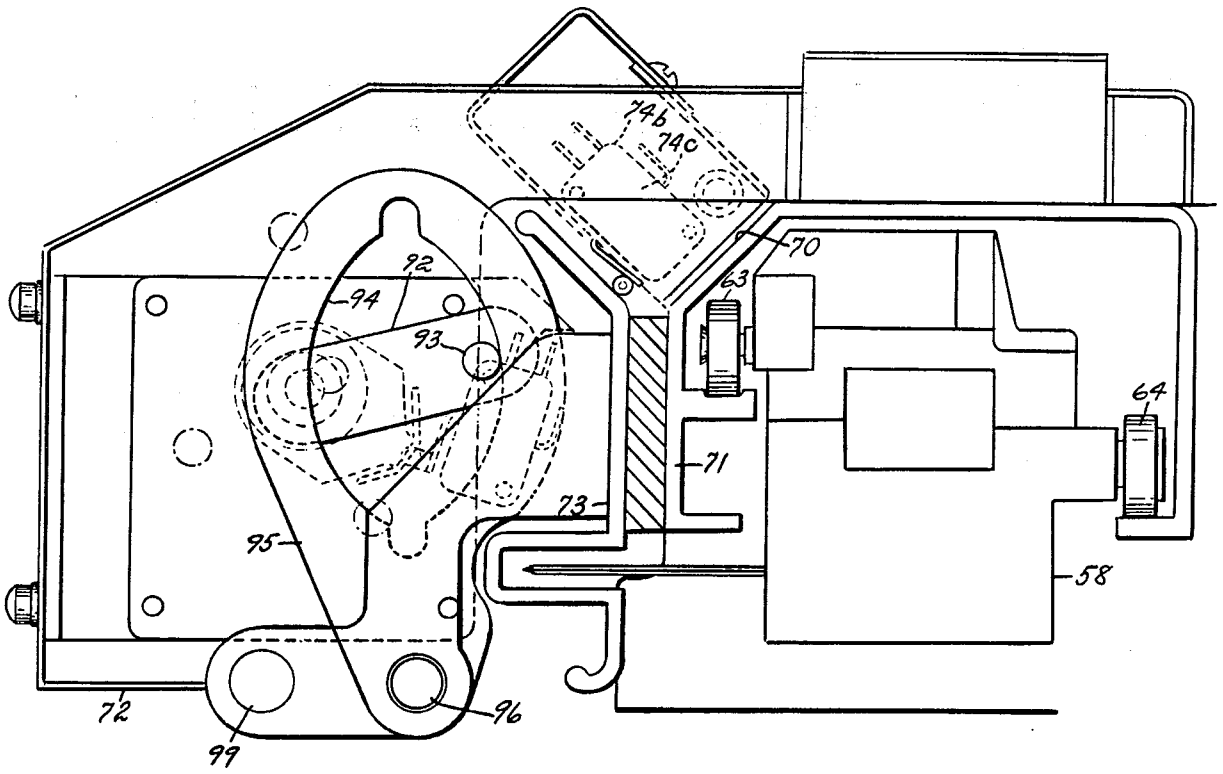
FIG. 8 is a transverse sectional view of the cutter box showing cam actuating means for moving the movable walls thereof.

Referring to FIGS. 5 and 8, the cutter assembly 58 is supported on first and second sets of rollers 63 and 64, respectively, and supports a switch tripping bar 65 which progressively actuates at each end thereof first, second and third switches 66, 67 and 68, the function of which will be described hereinafter.

Figure 3:
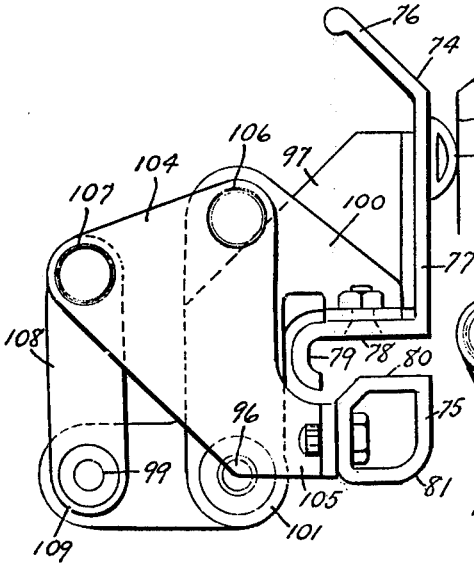
FIG. 3 is a fragmentary enlarged transverse sectional view as seen from the plane 3—3 in FIG. 2.
Figure 4:
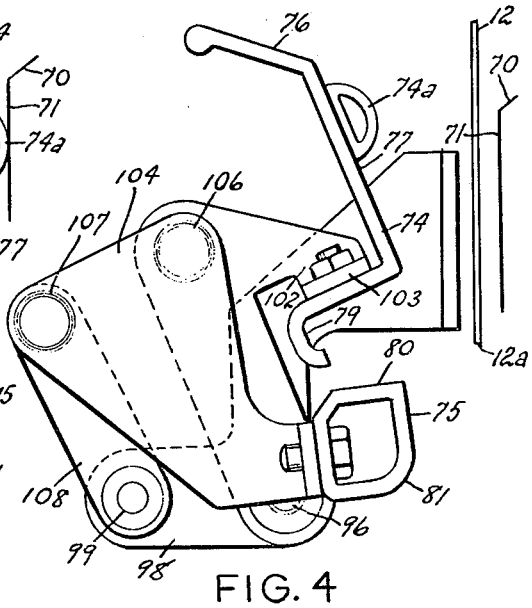
FIG. 4 is a sectional view, similar to that seen in FIG. 3, showing certain of the component parts in altered relative position.

Referring to FIGS. 3, 4 and 8, the cutter box includes an angularly disposed wall section 70 and vertical wall section 71 forming part of a channel through which the cloth web passes. An outer wall assembly consists of a movable outer wall 73 including an upper wall member 74 mounting a resilient clamp 74*a*, and a lower wall member 75. The upper wall member 74 includes an angularly disposed portion 76 symmetrical with the wall 70 and a vertical portion 77 symmetrical with the wall 71, as well as a horizontal portion 78 and short vertical portion 79 forming a part of the trough in which the cutting blade of the cutter assembly 58 moves during a severing operation. The lower wall member 75 forms the remaining portion of the trough, and includes a horizontal portion 80 and a vertical outwardly flared portion 81.

Figure 2:
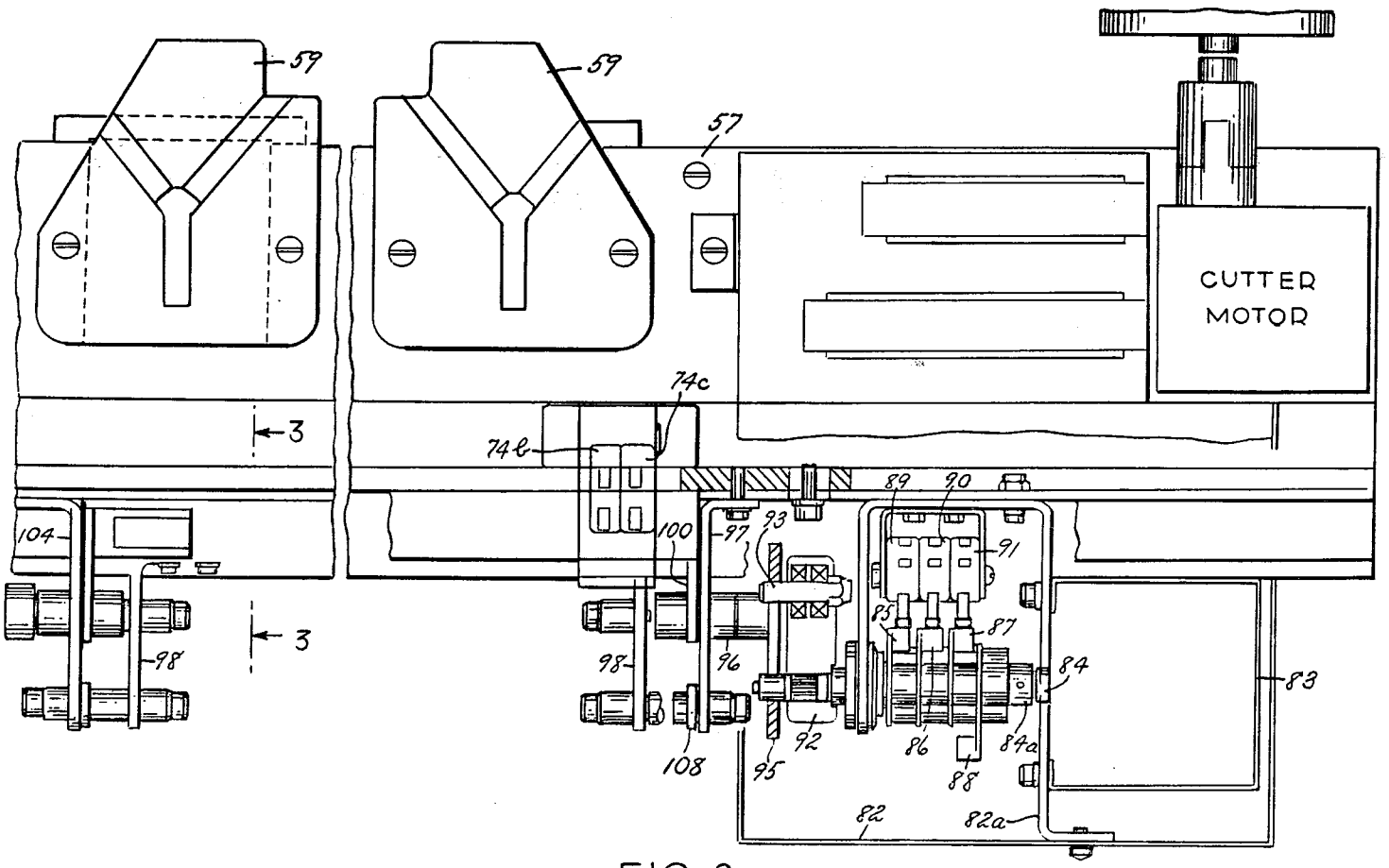
FIG. 2 is a fragmentary top plan view of a cutter box attachment forming a part of the disclosed embodiment.

Referring to FIG. 2, a housing 82 encloses a bracket 82*a* disposed at each of the cutter box which monts a motor or rotational soleniod 88 having an output shaft 84 and shaft extension 84*a*, mounting first, second, third and fourth cams 85, 86, 87 and 88, respectively. The cams 85–88 are positioned to engage first, second and third switches 89, 90 and 91, respectively, to accomplish functions described hereinbelow. The shaft extension 84*a* mounts a crank 92 having a pintle 93 bearing against the surface of an opening 94 in an internal cam lever 95 as shown in FIG. 8. The motor driven crank 92 causes the pintle 93 to move in a counter-clockwise circular orbit about shaft extension 84*a* without causing cam lever 95 to rotate, since the internal cam surface radius is equal to the outer orbit radius of pintle 93. As the pintle enters the lower cam notch it causes cam 95 to rotate until the opposite internal cam surface is contacted. The crank arm drive motor does not require precise control since the pintle may be stopped at any position between the lower and upper notches without causing cam lever rotation. The cam lever is caused to move in the opposite direction as the pintle enters the upper notch. Where the width of the cutter box is less than 72 inches, the above structure may be required at only one end of the cutter box. Greater widths of cutter box will require symmetrically positioned simultaneously operating structure.

As shown in FIGS. 2, 3, and 4, the cam lever 95 is mounted upon a shaft 96 supported in a bracket 97 at each end of the cutter box. An extension of bracket 97 supporting the shaft 96 determines a fixed pivot point 99 on the same horizontal level as the shaft 96. An upper wall bracket 100 has a lower end 101 fixed to the shaft 96 for rotation therewith, and a longitudinally extending member 102 having a flange 103 abutting an outer surface of the upper wall member 74 to which it is interconnected. A lower wall bracket 98 includes a lower end 105 mounting the lower wall member 75. This bracket includes a first pivot point 106 interconnected to the upper wall bracket 100, and a second pivot point 107 interconnected with a link 108, the opposite end 109 of which is mounted for rotation about the point 99.

A comparison of FIGS. 3 and 4 illustrates the movement of the upper and lower wall members 74 and 75 between relatively open and closed positions. It shoud be observed that when the cutter box is closed during the return stroke of the fabric spreading carriage, elastomeric clamp 74*a* prevents disengagement of the severed fabric end 12*a* due to carriage motion caused air pressure. The cutter box is opened as in FIG. 4 to unclamp the fabric and permit unimpeded movement of the fabric. The lower wall member 75 is simultaneously moved away from the closed position in order to avoid entrapment of the severed fabric end 12*a* as it descends at the commencement of fabric spreading.

OPERATION

Assume the carriage 10 to start the commencement of the spreading of a ply of fabric with the cutter box 57 in open condition as shown in FIG. 4, the clutch means 28 engaged and brake 48 disengaged. The carriage 10 will move leftwardly as seen in FIG. 1, to an end of the table 11, where it is stopped by contact with cams on the table operating switches on the carriage (not shown) as well known in the prior art. In prior art constructions, a similar switch causes operation of the cutter assembly 58. In the present embodiment, the corresponding switch commences operation of the motor 83 which rotates the crank 92 through approximately 180° where actuation of switch 91 removes power from motor 83 and where cam lever 95 is caused to close the upper and lower wall members 74 and 75, resulting in the clamp strip 74*a* engaging the fabric web 12 between it and the wall 71, this motion simultaneously closing a switch 74*b*. The movement of the output shaft 84 has also caused cam 86 to close switch 90. The switch 90 is in series with switch 74*b*, a completed circuit serving to commence operation of the cutter assembly 58 to traverse the length of the cutter box in either direction whereby the web 12 is severed. As the cutter assembly reaches the end of its stroke, the corresponding switches 66, 67 and 68 are closed. Switch 68 reverses the direction of current to the motor driving the cutter assembly, thus readying it for the subsequent cutting operation. Switch 67 connects current to the motor driving the carriage 10 causing it to commence movement in an opposite direction (rightward as seen in FIG. 1), and switch 66 upon contact opens the circuit to the cutter assembly motor at the end of the path of travel of the cutter assembly.

The actuation of switch 91 having stopped the motor 83, it maintains the wall 73 an 74 in closed condition. Switch 74*c* having been actuated by the closing of wall 74 operates the solenoid 42 to disengage the clutch means 28 and engage the brake facings 47 and 48 whereby the web is not only clamped by the strip 74*a*, but the positive drive roll 24 is locked to prevent any shifting of phase between spreading cycles.

With the walls 74 and 75 in closed conditions, and the positive drive roll 24 locked against movement, the carriage 10 returns to the opposite end of the table, where corresponding switches (not shown) halt the carriage and again energizes the motor 83 which rotates the output shaft 84 through approximately another 180° until the fourth cam 88 again contacts the third switch 91 and stops the motor 83. During this rotation, cams 85 and 86 part contact with the followers of switches 89 and 90, the walls 74 and 75 are caused to open and the clutch means 28 becomes re-engaged. The carriage again commences leftwardly as seen in FIG. 1 to resume feeding of the fabric web for a subsequent ply. This operation continues automatically until the supply of fabric is exhausted or the device manually stopped.

It will be observed that by virtue of the fact that the fabric web is intermittently clamped within the cutter box itself, the fabric feed roller is prevented from rotating at any time during non-spreading carriage motion, and minimal backlash is experienced in engagement of the fabric feed roller clutch pins at the start of spreading, so there is no requirement for a catcher or other fabric clamping means at one end of the table to assure retention of the superimposed fabric plys in proper relation. Further, since loss of phase is effectively prevented, there is no need to manually align each succeeding cut edge with the edge of a fabric ply previously deposited on the table.

Figure 9:
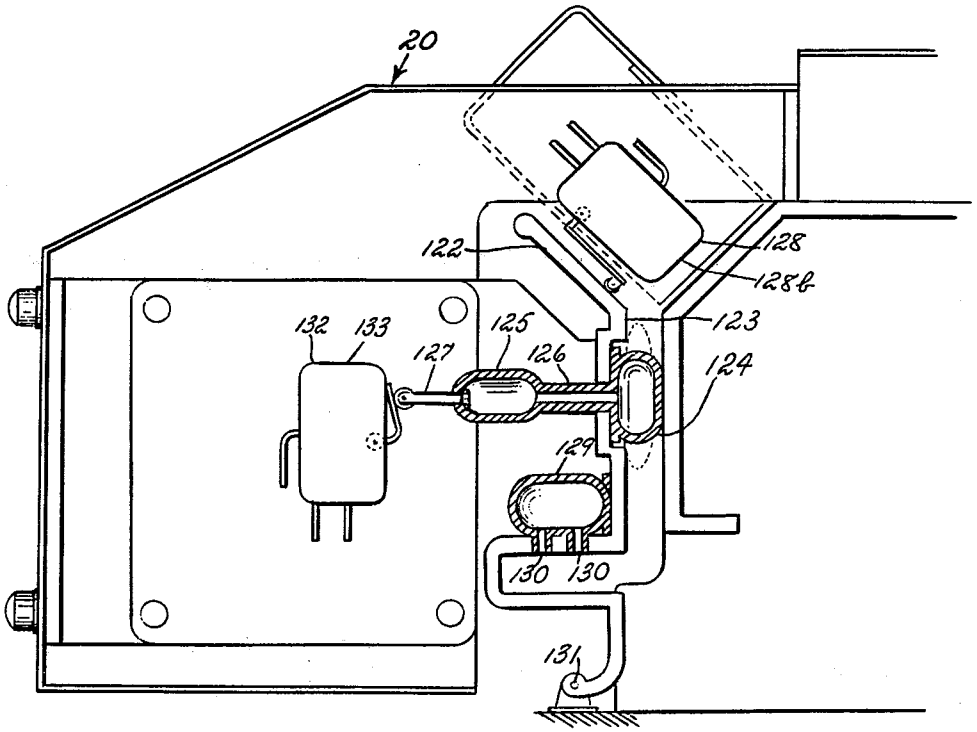
FIG. 9 is a transverse sectional view of the cutter box of a second embodiment of the invention.

Turning now to the second embodiment of the invention illustrated in FIG. 9, the device, generally indicated by reference character 20 differs from the principal embodiment in the execution of the clamping action within the cutter box by pneumatic means rather than mechanical movement of the wall members 74 and 75.

The embodiment includes a fixed outer wall 122, the inner surface 123 of which is provided with an inflatable strip 124 forming a clamping means. A compressed air manifold 125 supplies air through a tube 126 to the clamp 124 and operates an air piston 127 operating a switch 128 corresponding to the switches 74*b* and 74*c*. The switch 128 can also be actuated by the closed door, as is switch 74*b* and 74*c*. Where this is done, the piston 127 actuates switches 132 and 133 which are the equivalent of switches 89 and 90 in FIG. 2 of the principal embodiment.

A second manifold 129 supplies compressed air to a plurality of jet openings 130 which continuously or intermittently supply air to the cutting trough, to prevent the catching of a cut edge of the web after a severing operation. The wall 122 may be pivoted at 131 and maintained in closed condition by manually operated latch means (not shown) whereby the wall 122 may be opened for an initial threading operation required at the commencement of the loading of a fresh roll of cloth.

I claim:

1. Cutter box construction for use with a wheeled fabric spreading carriage having a supply of fabric thereon from which a web of fabric emanates, said cutter box construction comprising: a housing having first and second parallel walls, said walls defining a first upper opening and a second lower opening through which said web of fabric passes, cutting means arranged for movement transversely of said web in the interstice between said first and second walls, and means supported within said housing for clamping said web selectively only between said supply and said cutting means, whereby a segment of said web severed by said cutting means may fall free through said lower opening after severance, while the remaining portion of the web is selectively maintained in predetermined fixed relation relative to said housing.

2. Structure in accordance with claim 1, in which said clamping means is operated by movement of one of said walls relative to the other.

3. Structure in accordance with claim 1, in which said clamping means comprises a pneumatically inflatable member for varying the effective distance between the inner surfaces of said first and second walls.

* * * * *